US006840397B1

(12) United States Patent
Rosenberg

(10) Patent No.: US 6,840,397 B1
(45) Date of Patent: Jan. 11, 2005

(54) CONTAINER WITH STRAW OR UTENSIL

(75) Inventor: Baruch Rosenberg, P.O. Box 147, Hod-Hasharon (IL), 45101

(73) Assignee: Baruch Rosenberg, Hod-Hasharon (IL)

( * ) Notice: Subject to any disclaimer, the term of this patent is extended or adjusted under 35 U.S.C. 154(b) by 0 days.

(21) Appl. No.: 09/719,154

(22) PCT Filed: Jun. 29, 1999

(86) PCT No.: PCT/IL99/00358

§ 371 (c)(1),
(2), (4) Date: Dec. 12, 2000

(87) PCT Pub. No.: WO00/01585

PCT Pub. Date: Jan. 13, 2000

Related U.S. Application Data

(60) Provisional application No. 60/091,653, filed on Jul. 2, 1998.

(51) Int. Cl.[7] ..... A47G 19/22

(52) U.S. Cl. ..... 220/707; 220/708; 220/709; 220/710

(58) Field of Search ..... 220/707, 708, 220/710, 709; 215/388; 229/103.1

(56) References Cited

U.S. PATENT DOCUMENTS 2,450,244 A * 9/1948 Lynch ..... 229/103.1
3,559,868 A * 2/1971 Chang ..... 229/103.1
4,923,083 A * 5/1990 Forbes ..... 220/705
5,172,827 A * 12/1992 Chang et al. ..... 220/707
5,687,972 A * 11/1997 Petrak ..... 277/349

* cited by examiner

*Primary Examiner*—Joseph Man-Fu Moy

(57) ABSTRACT

Containers for beverages, e.g. cans for soft drinks are provided with a tubular lever arranged on the top part of the can. The lever (L) is mounted with possibility to pivot and once pivoted to pierce by its one extremity (17) the can's top and to perforate it. The piercing extremity (17) is connected to a flexible extension (38) protruding into the can and through which the content of the container can be consumed. In one of the embodiments the extension (38) is formed as folded tubular member made of plastic material. Once the can is perforated the extension is capable to unfold and fall into the can so as to approach the beverage and to allow its consumption.

9 Claims, 9 Drawing Sheets

CONTAINER WITH STRAW OR UTENSIL

This application is a 371 of PCT/IL99/00358 filed Jun. 29, 1999 and claims the benefit of Provisional application Ser. No. 60/091,653 filed Jul. 2, 1998.

BACKGROUND OF THE INVENTION

In this invention, one small and strong metal tubular lever is doing the following main important activities. It is opening and closing the can and it is also making it possible to drink from the tubular lever, which is very helpful and efficient.

Many efforts were made in the past and hundreds of patents were granted in the subjects of opening the cans, for closing the cans and also for making it possible to drink the beverages from the cans. Now all the above-mentioned activities are made in an easy way with only one small simple tubular lever.

It is also an object of this invention to provide a new utensil which is easily packaged and used with many types of food and beverage products.

There were many kinds of utensils invented before, but usually they were not useful because of different reasons. For example, in the inventions, U.S. Pat. No. 3,931,924 (paperboard container lid convertible into a spoon) and U.S. Pat. No. 3,828,999 (package including disposable utensil), before using the spoon one should first to prepare it by assembling its pieces together, which is not always comfortable especially for people that do not have enough time and knowledge how to build the spoon.

DESCRIPTION OF THE PROBLEM

The problems were how to open the cans, how to close them and how to drink the beverages in the most convenient way, that is also very hygienic.

It was also a problem, how to make the can safe for the use of small children, because even now there is a danger that a small piece of metal that is on the can could be very dangerous especially for small children.

SOLUTION OF THE PROBLEM

With the new system, it is possible that it will be easy to drink the beverages while no dust and other not hygienic things, will be able to enter the places from where we drink the beverages, because in the new systems of this invention, it is possible to drink from a clean tubular lever functioning as a straw. The lever is covered with a clean plastic cover which is removed before drinking the beverages. In this invention, there will not be a small part of metal that can be lost or in any way could be dangerous for small children.

The above mentioned systems and other advantages of this invention, will be more understood with the following drawing and specifications.

In this invention, the strong metallic tubular lever performs several important activities. The lever is suitable for opening and closing the can and for drinking thus eliminating the necessity in a straw or the necessity to drink directly from the can.

In this invention, there are added new systems to the previous systems, and as a result of it, the old inventions that are sometimes not useful could be more efficient with the new improvements added in the enclosed systems.

The systems that are added are also safe especially for very young children, because all the parts are large, and there is no risk, that they will be swallowed by the children.

DETAILED DESCRIPTION OF THE PREFERRED EMBODIMENTS

Figure 1:
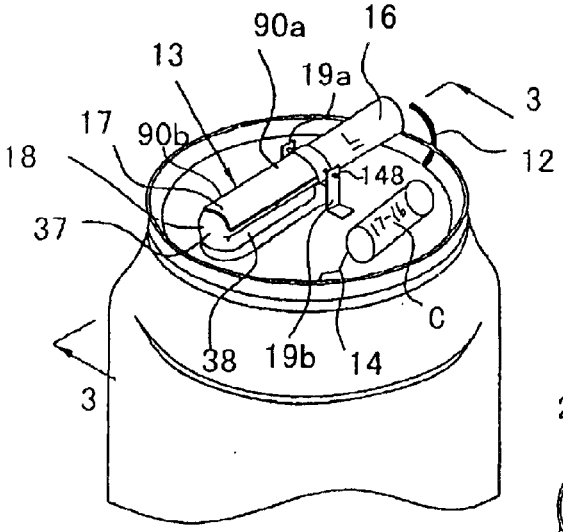
FIGS. 1–10 are various perspective and sectional views of the invention referring to a can.
Figure 2:
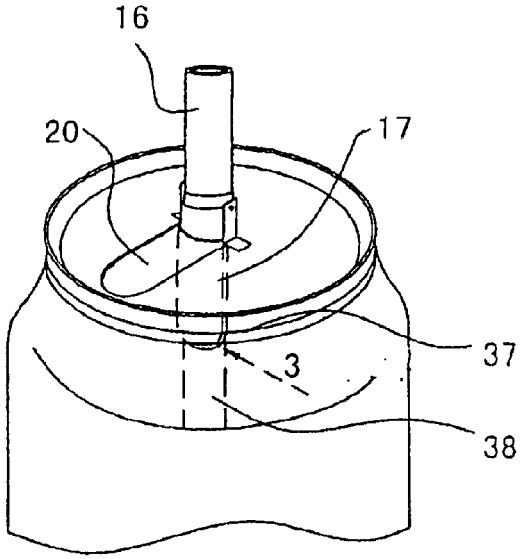
Figure 3:
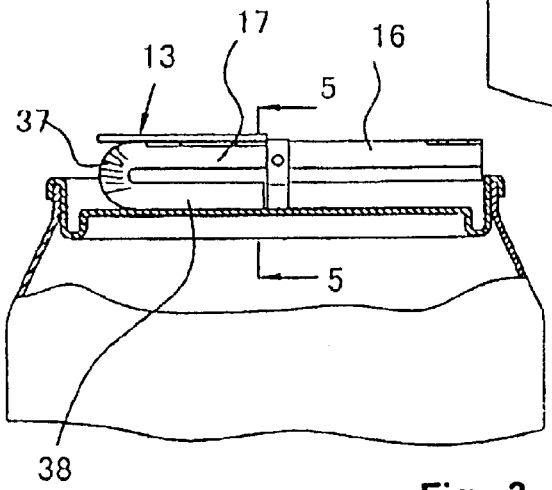
Figure 5:
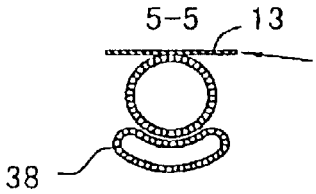
Figure 6:
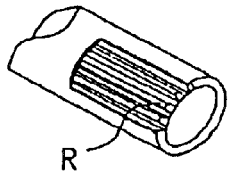
Figure 4:
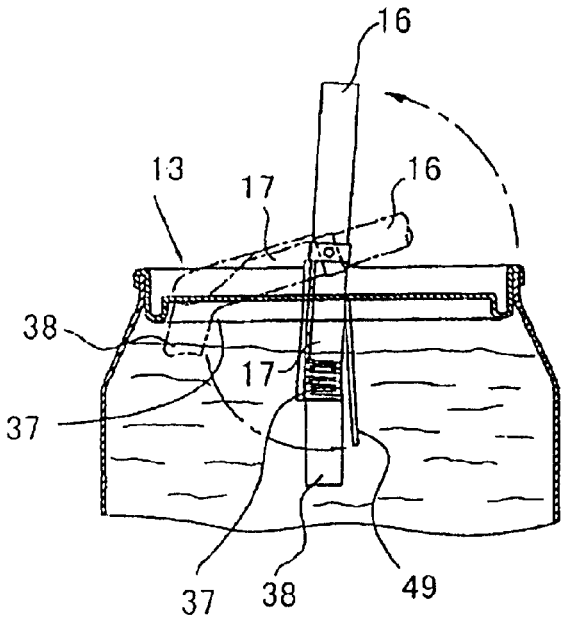

Referring now to FIG. 1, a lever L is shown having its opposite extremities 16, 17. The lever is formed as a tubular member made of strong metallic material. The lever is situated on the top of the upper cover of a can. The lever is mounted with possibility for pivoting about two axles 14*a*, 14*b* secured on corresponding legs 19*a*, 19*b* of a stand secured on the upper cover of a can. By virtue of this provision the lever can be pivoted up and down according to our desire. When the extremity 16 of the lever is lifted up the lever can be used for opening the top upper cover part of the can. As we lift up the extremity 16 the opposite extremity 17 is moving down, protrudes into the cover and creates in it an opening 20 as shown in FIG. 2. As the extremity 17 is moving down into the can and approaches the beverage, the opposite extremity is moving up and can be used for drinking the beverages therethrough. Since the length of the lever might be insufficient to approach the level of the beverage the extremity 17 is provided with a flexible tubular extension 38, connected to the lever by a connecting passage 37. The extension is made of metal or plastic. The extension can be situated under the lever being folded as shown in FIGS. 1, 3, 4. In FIG. 5 is also seen a cross-sectional configuration of the extension and in FIG. 6 is shown that the extension can be also provided with plurality of longitudinal reinforcing ribs R.

A plastic cover 18 usually covers the lever so that is remains clean while drinking the beverages.

In FIGS. 1, 2, 3, 4 and 5 there is shown also a flexible seal 13 associated with the lever. The seal is made of flat plastic or rubber that will close the can it has been opened. As we will move the extremity 16 of the lever up, the extremity 17 goes down and opens the can. Simultaneously the seal enters via the opening 20 into the can. Once we will be interested to close the can, then we will pivot the lever, the extremity 16 of the lever will go down and as a result of it, the extremity 17 of the lever moves up. The lever can be secured in this position for example by a strong metallic clamp 12 that is attached to the top of the can as shown in FIG. 1. In this position the seal is pressed tightly to margins of the opening and thus prevents spill the beverages out of the can.

It is important to close also the extremity 16 of the lever so that the beverage will not spill out therethrough. For this purpose a flexible cover C made of plastic or rubber can be used. The cover is connected to the upper part of the can by a strong flexible string 14. The string is long enough to enable putting the open extremity 16*a* of the cover on the extremity 16 of the lever. Since the opposite extremity 16*b* of the cover is closed it can be readily appreciated that once the cover is put on the lever it can be kept in good hygienic condition We can also put similar flexible plastic or rubber cover on the extremity 17 of the lever, however its dimension should accommodate the extension 38 and seal 13.

Figure 9:
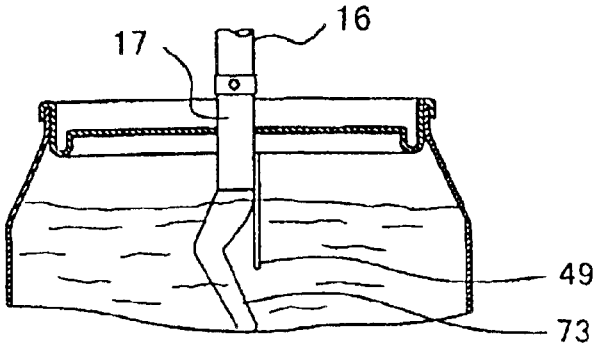

In FIG. 4 and FIG. 9, it is seen that the can is opened after the lever has been pivoted and its extremity 17 pushed down so as to reside within the can's interior. During pushing the extremity 17 down the can is being ruptured and an opening or perforation 20 is created while the torn portion 49 of the can is bent inwardly as shown in FIG. 4 and FIG. 9.

Figure 7:
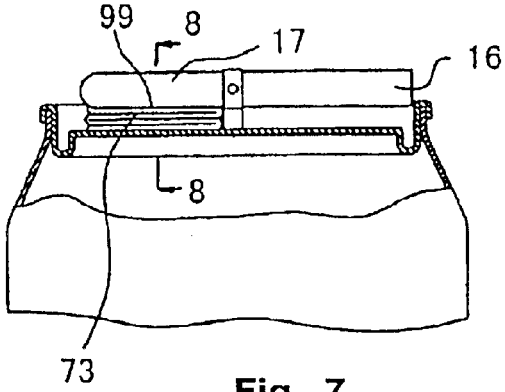
Figure 8:
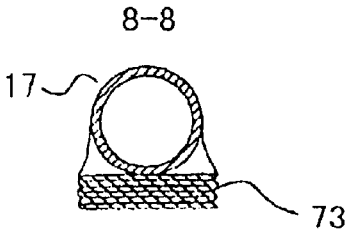

It is important to mention that the metal or plastic extension 38 is flexible and extensible to enable location thereof within the can for most convenient consuming the beverage irrespective whether the can is full or almost empty. It is also possible to form the extension with several folds 73 as seen in FIG. 7 and FIG. 8. This embodiment is depicted in FIG. 8 and it comprises folded extension made of aluminum tube. This extension can be unfold and fall down once the lever is pivoted and the extremity 17 thereof is pushed down. In this situation the extension falls down until it approaches the bottom of the can and thus it is easy and convenient to consume the can's content. The embodiment shown in FIG. 7 comprises also sharp metal teeth 99 affixed to the lever to facilitate piercing of the can. It is not shown specifically but should be realized that the configuration of the lever can be different. For example it can be oval, so that it will occupy not too much space.

The features referring to the sealing of the can were mentioned before and there is added here another feature to improve this function. The seal 13 is shown as mentioned before in FIGS. 1, 2, 3, 4 and 5. The flexible seal 13 is made of plastic material or rubber and is slightly wider than the opening 20 which is being pierced in the can when the lever is pushed down. For the flexible seal 13 is wider than the opening it will not be able to return back outside the can.

Figure 10:
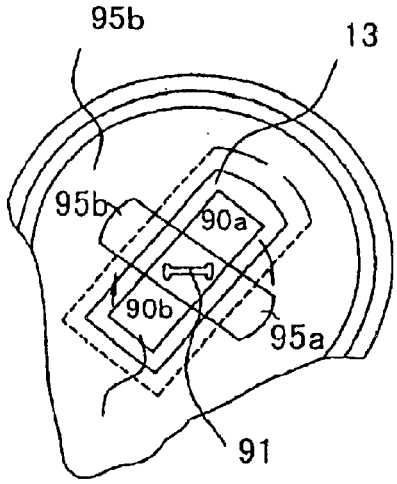

In FIG. 10 another embodiment of the sealing system is shown. This embodiment comprises a thin metallic plate P. The plate resides on the lever and is releasable affixed to the seal 13 by virtue of a tightening screw 91. The plate can be displaced with respect to the seal so as to be directed either along the seal or across the seal. When the plate is along the seal its extremities are designated at 90*a*, 90*b*. From this position the plate can be displaced across the seal and in this position its extremities are designated at 95*a*, 95*b*. As there is a need to seal the can, than the screw is loosed and the metal plate is indexed into a new position in which its extremities moved to a new place. By virtue of this provision it is possible to seal the can very easy and reliably.

It is important to mention, that the above described construction can be used not only in combination with metallic cans but is also suitable for opening or closing other receptacles made of other materials, e.g. plastics.

Referring now to FIGS. 16–25 the other part of my invention referring to an utensil will be disclosed.

Figure 11:
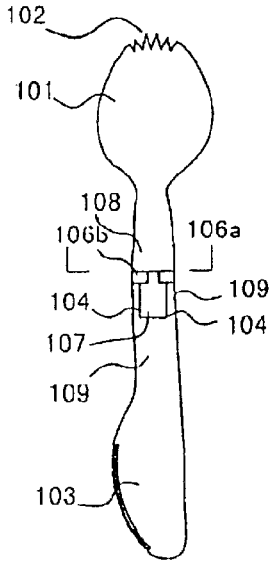
FIGS. 11–25 illustrate another aspect of my invention referring to an utensil.

In FIG. 11 is shown an utensil comprising a spoon 101 and a knife 103. The spoon is formed with notches 102 to enable its use as a fork. The knife 103 is connected with the spoon 101 along a transverse axis 104 preferably made of plastic material. The connection can be made by using hot welding, or a press, or other known means suitable for the production of spoons, forks and knifes.

In the middle of the utensil body on both opposite sides are formed very small tongs 105*a*, 105*b* which are made of plastic material and can be bent in a position correspondingly designated at 106*a*, 106*b*. It is possible to bend those two plates of plastic (or plastic with metal) and thus to hold together the spoon 101 and the knife 103.

From the far end of the handle of the spoon 101 until the place where the two plates of plastic (or plastic with metal) 105*a*, 105*b*, 106*a*, 106*b* the plastic part 107 is more narrow that the plastic handle 108 of the spoon 101 and fork 102 because the plastic 107 should be able to be between the two plates of plastic (or plastic metal) 105*a* and 105*b* while the other plate of the handle 108 is wide, like the handle of the knife.

Figure 15:
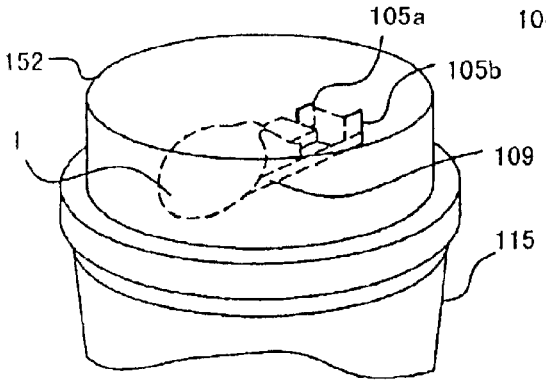
Figure 12:
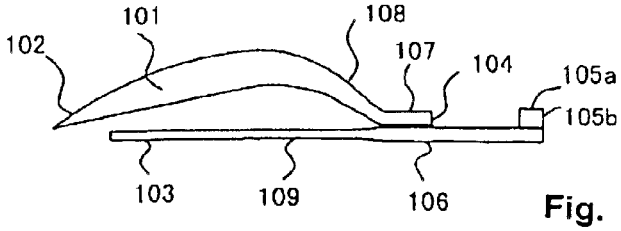

In FIG. 12, the spoon 101 and the knife 103 are very close together, while the flexible axis 104 is bent and, as a result of this situation it was made possible for the spoon 101 and fork 102 and knife 103 to become very small, so that it can be put very easy, as it is shown in FIG. 15, between the seal 151 of silver paper suitable for closing the container with food and the top closure of the container FIG. 15, 152.

As the spoon 101 and fork 102 is lifted up and also moved to the other side (that is far away from the cutter head of the knife) than it will be in the position, that is shown in FIG. 11.

Figure 13:
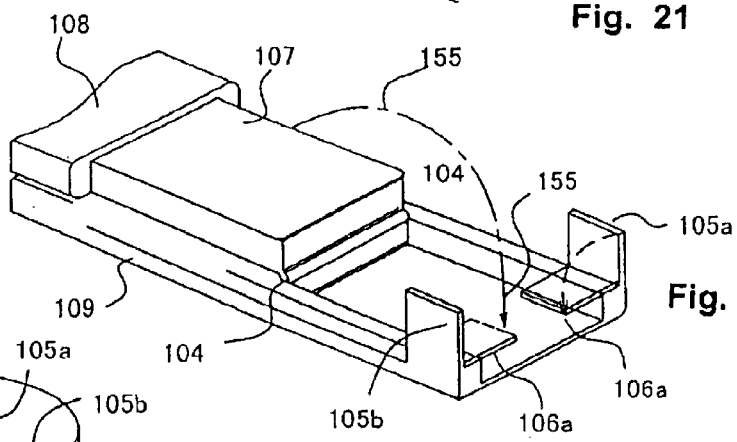
Figure 14:
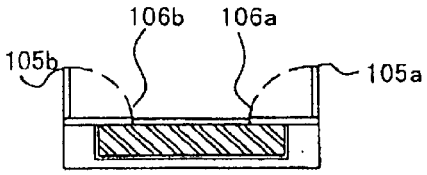

In FIG. 13 are shown enlarged details that are in FIG. 11 and FIGS. 14, 15 and especially in FIG. 12. As it was already described in FIG. 11 and FIG. 12, the small plastic (or plastic with metal) plate 105*a* moves down to 106*a*, and the plate 105*b* moves down to 106*b*, if there is a need to move the plates 105*a* and 105*b* on the spoon 101 and fork 102 handle 107 and 108.

The position of the spoon 101 and fork 102 handle 107 and 108 in FIG. 12 and the same situation is with the plastic (or plastic with metal) plates 105*a* in FIG. 11 and 105*b* in FIG. 12, like 105*a* and 105*b* in FIG. 11, FIGS. 14, 15. Also, the handle of the knife 109 is the same in FIGS. 11–13.

In FIG. 13 the movement of the handle 107, 108 of the spoon 101 and fork 102 is shown in the circle 155. The axis is 104 on which the spoon 101 and fork 102 and the holder 107 and 108 of it are moving.

Figure 16:
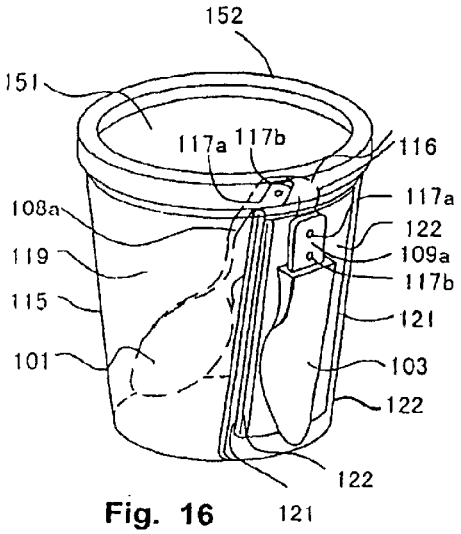

In the system shown in FIG. 16, the spoon is inside the container 115, for a food 199 and the knife with the tissues are outside the container, but it is also possible that the spoon with the knife and the tissues will be outside the container in a plastic bag.

In the system that is shown in FIG. 16, the spoon 101 is inside the food 119 that is inside the container 115. Instead of the handle 107 and 108 of the spoon FIG. 11 and FIG. 12 there is a rectangular rod 108*a* that is hollow in the inside, with square walls and is connected to the spoon 101. This short rectangular rod is connected to a handle of the knife 109*a* and the knife 103 with very slim plastic, or linen strips 116 that are going from the rectangular inside of the container, to the handle of the knife 109*a* that holds the knife and that are outside the container.

As we open the sealed silver paper 151 that closes the container 115 then it is possible to put the handle of the knife 109*a* on which there are two pins 117*a* and 117*b* that are raising about 4 mm out from the handle 109*a* the inside of the rectangular rod 108*a* where there are two holes 117*a* and 117*b* and as a result of it, the two pins 117*a* and 117*b* thar are on the handle of the knife 109*a* are entering into the two holes that are inside the rectangular rod. In this situation, the handle 109*a* of the knife 103 is inside the rectangular rod and it is holding very strong the rectangular that is connected with the spoon 101 and so it is very easy to eat the food from the container, while it is also very simple to take out the handle 109*a* with the knife 103 from the rectangular 108*a* that is together with the spoon 101 inside the food 119. While the handle 109*a* with the knife 103 are taken out from the container, it is possible to put it back into the plastic small bag 122 that keeps everything very hygenic with also clean tissue paper 121 where the knife 103 with the handle 109*a* were stored before they were put into the rectangular 108*a* inside the container. It is also possible that the pins 117*a*, 117*b* will be made from flexible material so that the pins will enter and go out in an easy way into and from the holes 117*a*, 117*b*.

Figure 17:
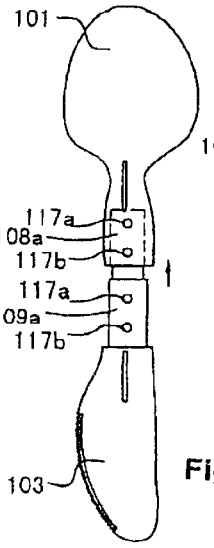

FIG. 17 shows how will be the situation of the spoon 101 and the knife 103 after the handle 109*a* of the knife together with the knife 103 will come inside the rectangular 108*a* so that the knife and the handle will be together with the spoon 101.

In the handle 108*a* of the spoon 101 there are two holes 117*b* and 117*a* and in the handle 109*a* of the knife 103, there are two pins 117*a* and 117*b* that will enter the holes 117*a* and 117*b*, as we will be interested to put the knife and the spoon together as it is shown also in the following FIGS. 18 and 19.

Figure 18:
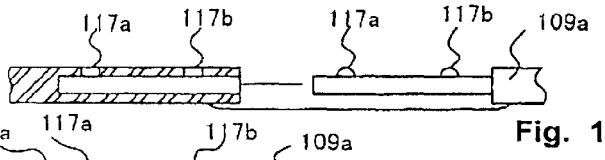

In FIG. 18, it is possible to see the situation that is also in FIGS. 16 and 17. In FIG. 18, it is shown the handle of the knife 103 with the pins 117*a* and 117*b* before they enter the handle 108*a* of the spoon 101 in which there are two holes 117*a* and 117*b*.

Figure 19:
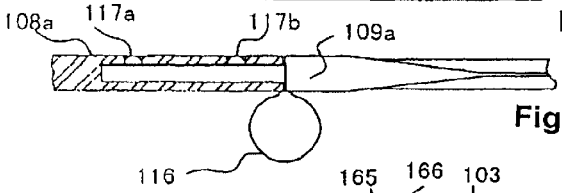

In FIG. 19, it is shown that the handle of the knife 109*a* entered the handle of the spoon 108*a* while the pin 117*a* enters the hole 117*a* and the pin 117*b* enters the hold 117*b*. The slim plastic or linen strip 116 that is connecting the handle 109*a* of the knife 103 with the handle 108*a* of the spoon 101 is shown also in FIG. 20 while in FIG. 18 one end of the plastic or linen strip is far from the other end and in FIG. 19 the two ends of the plastic/linen strip are close to each other.

Figure 20:
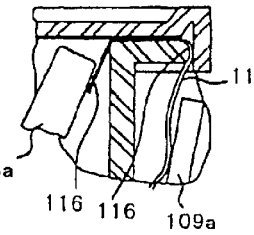

FIG. 20 shows the enlarged situation of the plastic or linen strip 116 that is connecting between the handle 109*a* of the knife 103 and the handle 108*a* of the spoon 101.

Figure 21:
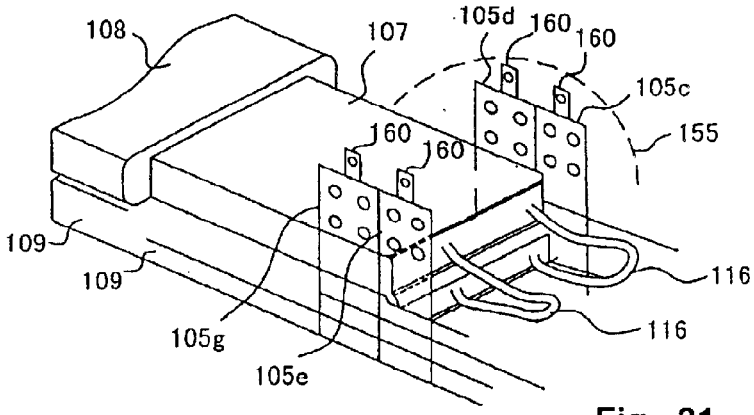

FIG. 21 is a very enlarged drawing of a new system. FIG. 21 is similar to FIG. 13. FIG. 13 is useful as it is shown how it is used in FIG. 15, but FIG. 13 is now useful for the system that is shown in FIG. 16 while the construction of FIG. 21 can be used for both, for the system that is shown in FIG. 15 and also for the system shown in FIG. 16. In the system that is in FIG. 21, there are slim plastic or linen strips, connecting the handles 108 and 109 of the spoon 101 and knife 103 instead of the lever 104 that is in the system that is shown in FIG. 13. In FIG. 21 there are more plastic (or plastic with metal) plates 105*c*, 105*d*, 105*e* and 105*f* and it is possible to add even more plastic (or plastic with metal) plates, so that the spoon 101 and the knife 103 will be held together very strong, in the following ways, that are similar to the system of plastic (or plastic with metal) plates. In FIG. 13, the plastic (or plastic with metal) plates 105*a* and 105*b*, that are built on the handle of the knife 109 and the plates 105*a* and 105*b* are moved down to the position 106*a* and 106*b* as it is needed to move the handle of the spoon 107, 108 so that the plates 105*a* and 105*b* will hold the handle of the spoon 107, 108 in the position 106*a*, 106*b* of the plates.

In FIG. 21, the plastic (or plastic with metal) plates are in different places than in FIG. 13 and there is no lever in the system that is shown in FIG. 11. If there are pins or buttons in the plates, they will be able to hold stronger the system, as also additional very small plates with pins or buttons 160 will be added. The system that is shown in FIG. 21 can be used in the systems described in the drawing that are in FIG. 15 and also in FIG. 16.

Figure 22:
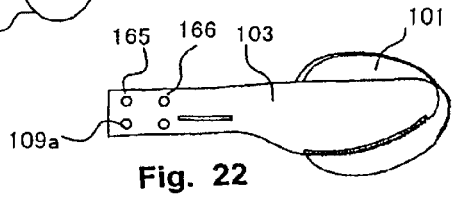

In FIG. 22, it is possible to see the knife 103 in which there are four pins 165 in the handle 109*a* of the knife and four holes 166 in the handle 108*a* of the spoon. The four pins 165 that are in the knife 103 can enter into the four holes 166 that are in the spoon 101 and as a result of it, the knife and the spoon are very close together.

The knife 103 with the spoon 101 and their holders are very slim and very small so they are able to enter many small places like in FIG. 15 between the silver paper seat 151 and the upper closure 152. The knife 103 and the spoon 101 can be put also into very small plastic bags, that can be handed on the walls outside the containers.

Figure 23:
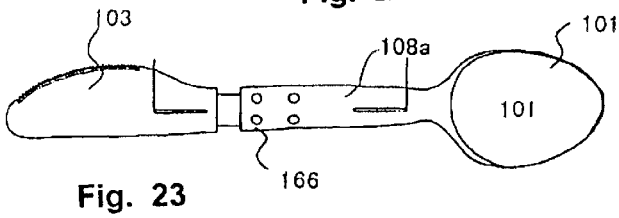

In FIG. 23, it is shown that the knife 103 and the spoon 101 are in a different position than they were in FIG. 12, but again the four pins that are in the handle 109*a* of the knife 103 were used to put them into the four holes that are in the handle 108*a* of the spoon 101 so that they are very close together and the knife and the spoon do not move while they are used for eating. In this FIG. 23, the spoon and/or the knife are ready for using them for eating.

Figure 24:
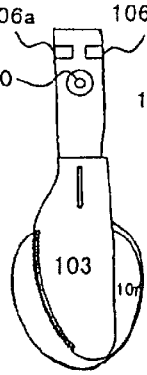

In FIG. 24, the holders/handles 108*a* of the spoon 101 and 109*a* of the knife are put together with a pivoting round screw 170. This pivoting round screw hold very close together the holders/handles of the spoon 108*a* and the holder of the knife 109*a*. Because it is important that they will not move, therefore two plates 106*a* and 106*b* are holding the handle of the knife and the spoon as it is also shown in FIG. 11 and FIG. 13.

Figure 25:
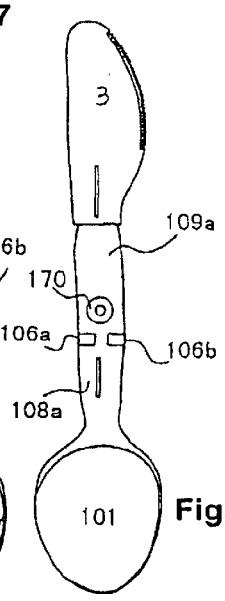

FIG. 25 shows the knife 103 and the spoon 101 while they are ready for using them for eating like in FIG. 24 the pivoting round screw 170 is holding the handles of the knife 109*a* and the spoon 108*a*. The plates 106*a* and 106*b* are holding together the handles of the knife 103 and the spoon 101, so they will not move while they are used for eating.

Turning now to FIGS. 26–30 it will be disclosed now some additional embodiments of the present invention which refer to a can.

Figure 26:
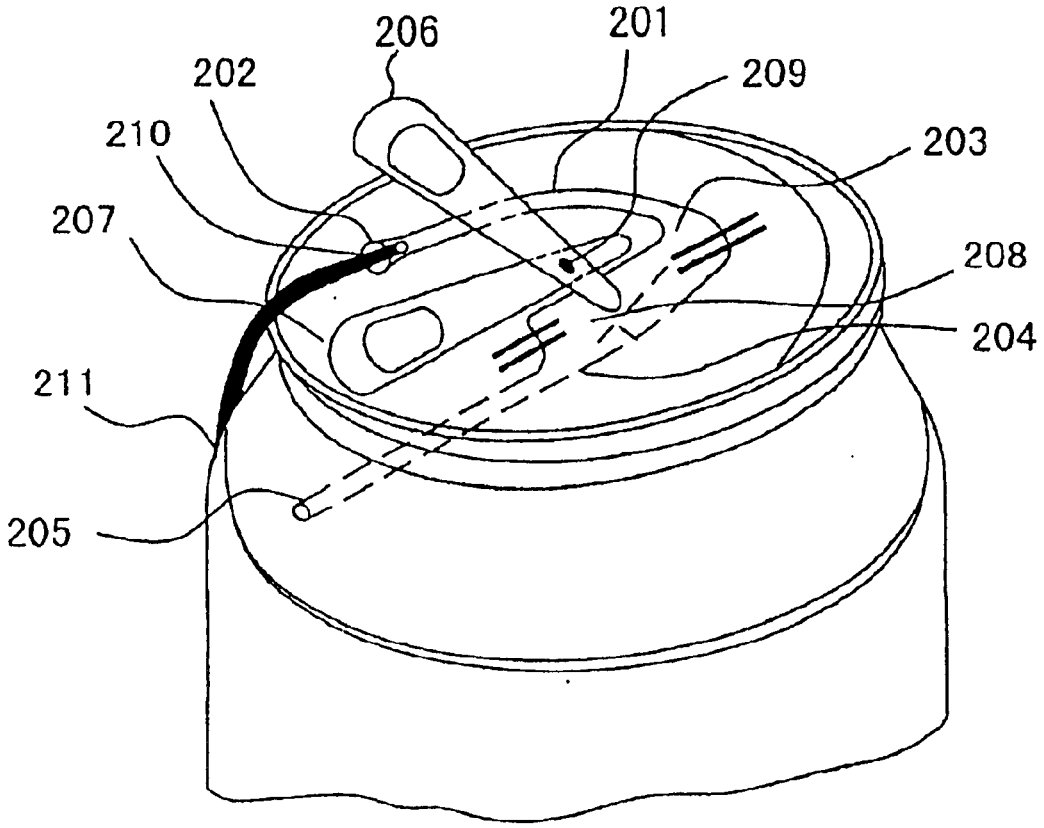
FIGS. 26–32 refer to additional embodiments of my invention referring to a can.

As seen in FIG. 26 a flexible plastic or made of soft metal straw or pipe 201 is situated on the upper part of the can and its opposite extremities are designated at 202 and 203. The pipe is used for drinking the content of the container therethrough. The extremity 203 of this pipe is located on the upper part of the can opposite the outlet 208 of a tubular extension 204 situated beneath the upper part of the can. The extension is shown by dotted lines and it is affixed to the upper part of the can. The distant end 205 of this extension approaches the level of the beverage in the can (not shown). The extension is affixed to the can with possibility for displacement so as to adjust its position for most comfortable consuming of the can consent.

When the pipe 201 is not in use the extremity 202 thereof is closed by a cork member 210, which can be entered into the pipe to prevent spilling out of the beverage. The cork member is affixed to the outside wall 211 of the can.

Figure 27:
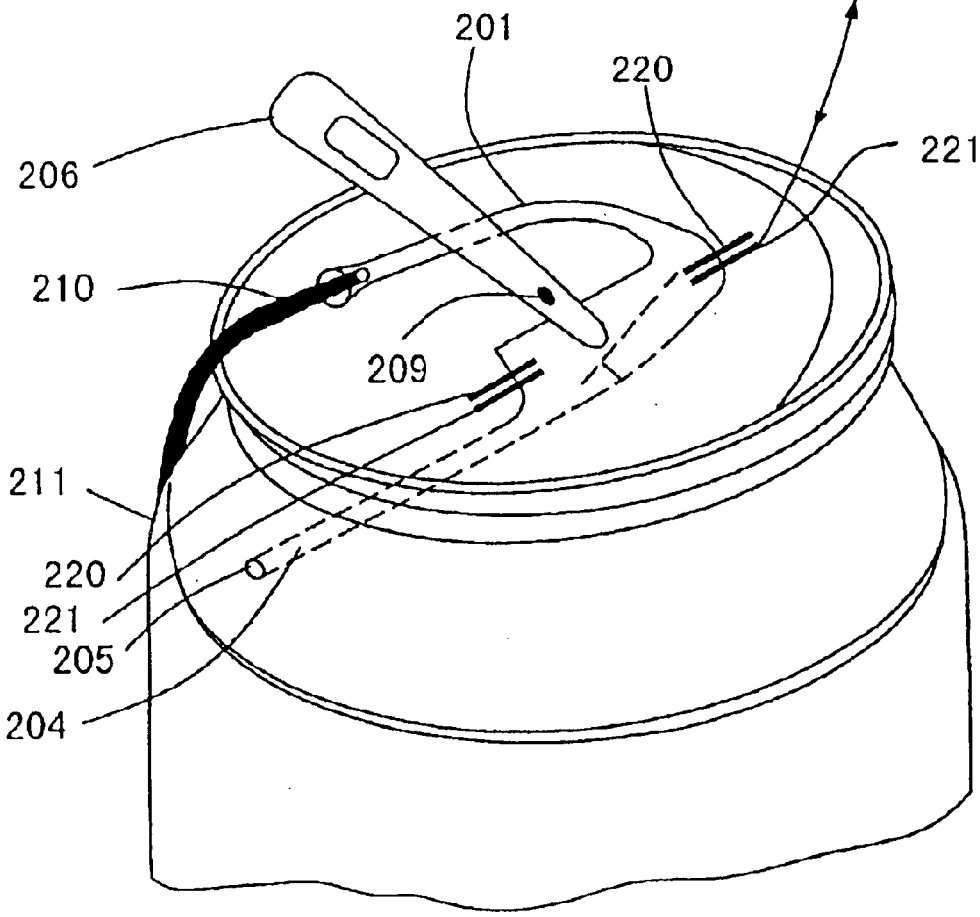

There is provided a lever which can be pivoted about its axis 209. When the lever is not in use it is in horizontal position as designated at 207 on FIG. 26. The lever in pivoted position is designated at 206 and it can be readily appreciated that in this position it perforate s the upper part of the can. With reference to FIG. 27 it is seen that the lever is located in such a manner that when it is pivoted it ruptures and perforates the upper part of the can opposite the outlet 208 of the extension When the upper part of the can is perforated the extremity 203 of the pipe 201 and the outlet 208 of the extension 204 are in communication and thus the content of the can be consumed.

Figure 28:
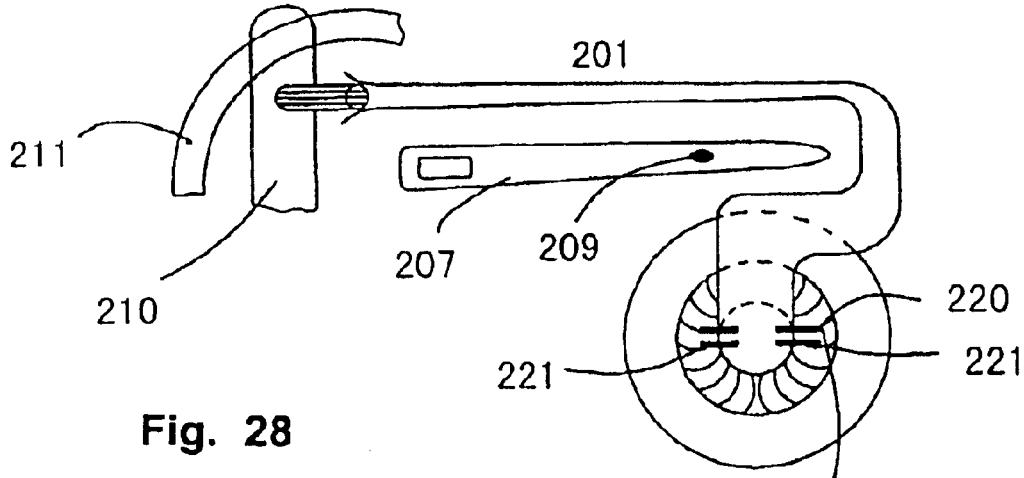

With reference to FIGS. 27, 28 it is seen that shown that the outlet portion 208 of the extension 204 is connected to the upper part of the can from beneath by its flange portion 221 while the extremity 203 of the pipe 201 is connected to the upper portion of the can from above by its flange portion 220. It is seen that flange portion 220 is opposite the flange portion 221. The connection can be effected for example by gluing or by hot welding.

Figure 29:
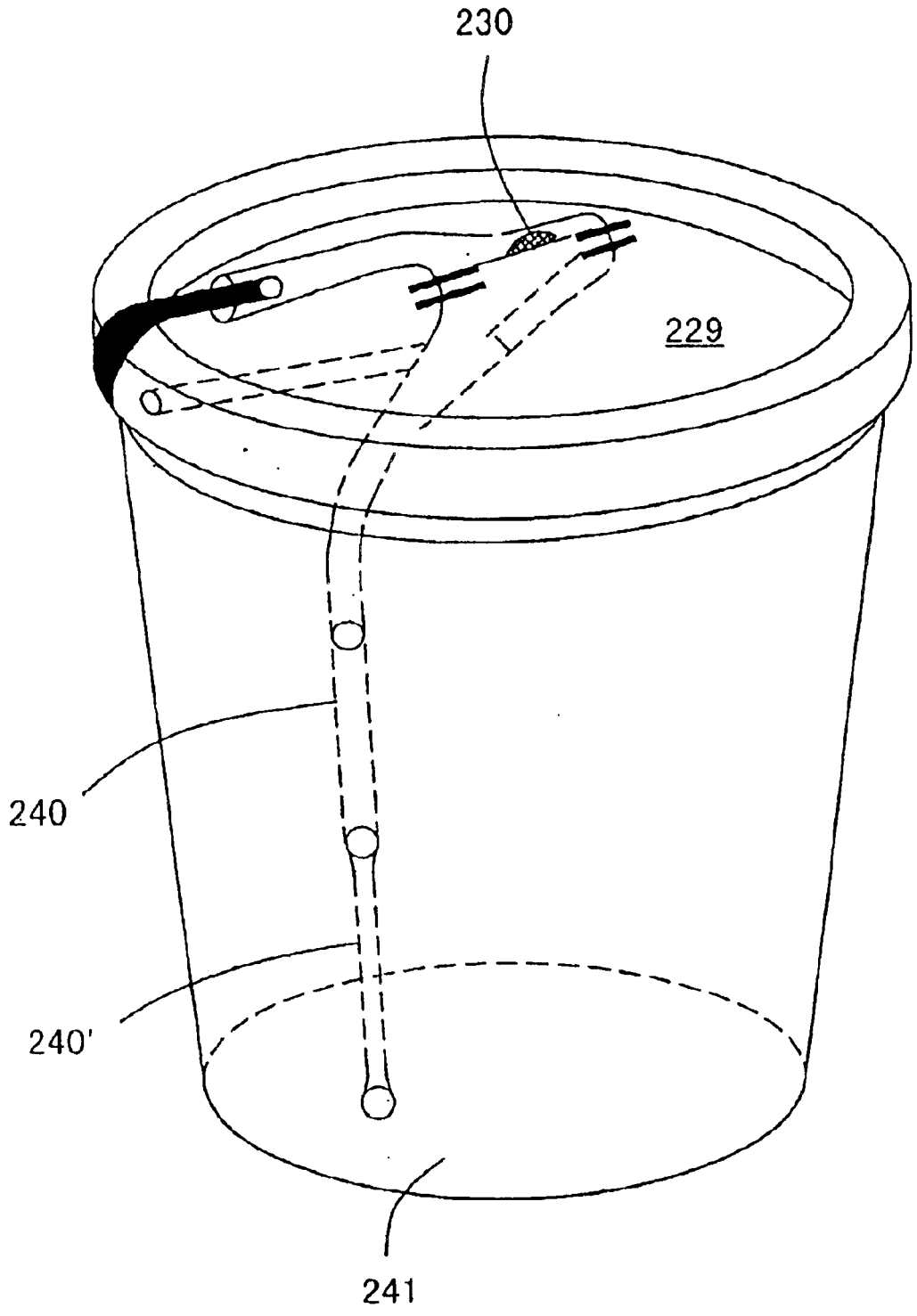

Turning now to FIG. 29 it is shown another embodiment of the invention which is especially suitable for containers closed by a plastic cover which can be easy perforated by a finger without necessity to use a lever. It is shown that a cover 229 of such a container is provided with a region 230 which can be easily perforated when pushed by a finger. The cover is provided also with a pipe situated above the cover and with an extension situated beneath the cover. The distant end of this extension can be connected with additional tubular members 240, 240' increasing its length so as to approach the level of the beverage even when it is in proximity of a bottom 241 of the container.

Figure 30:
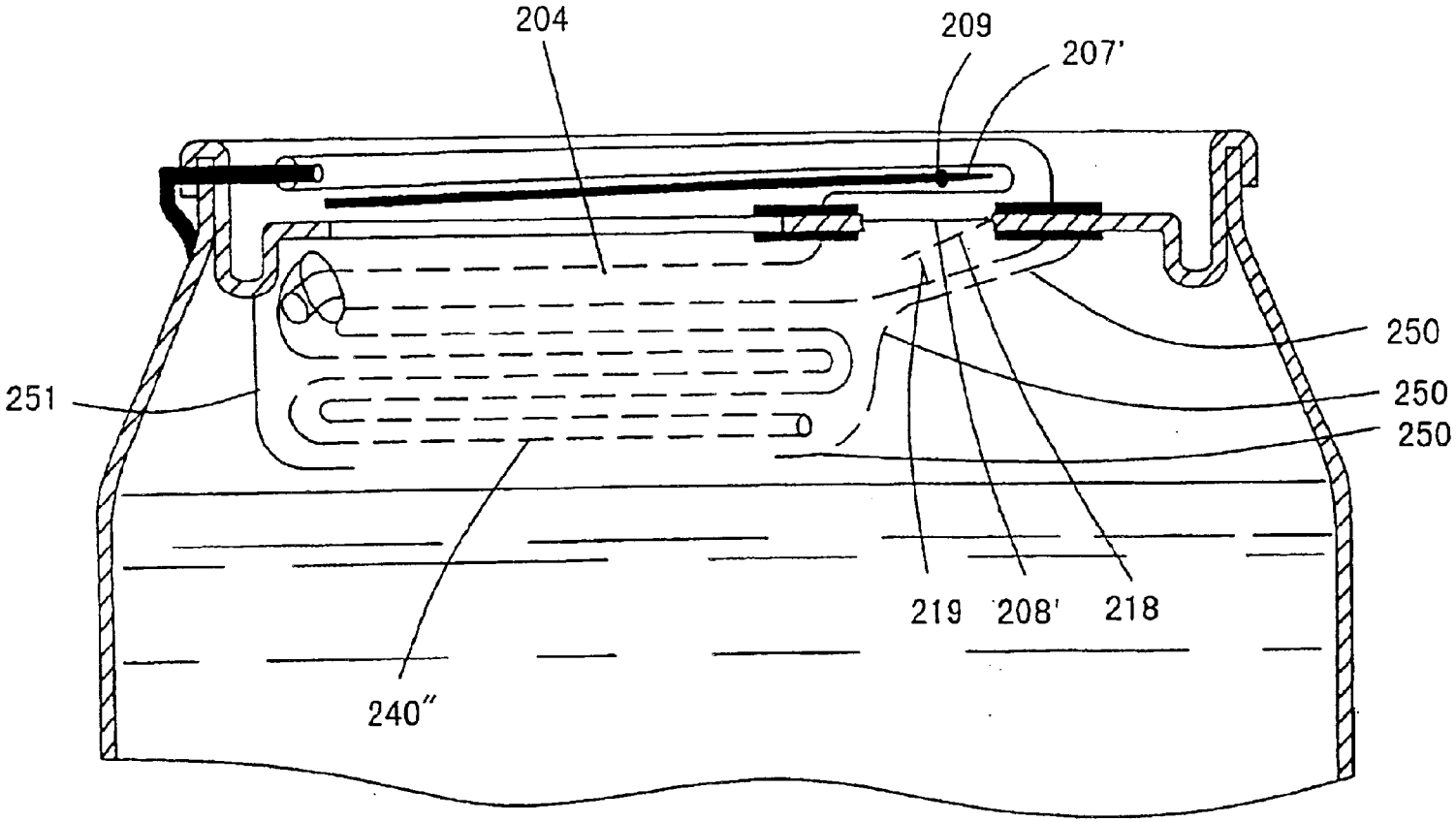

Referring to FIG. 30 it is depicted enlarged portion of the can with extension 204 comprising folded portion 240" residing beneath the upper part of the can within a basket, defined by its opposite sides 250, 251.

There is provided a bar 218, residing in the basket above the extension and oriented in such a manner that its end 219 is close to the side 250 of the basket.

Once the lever is pivoted about its axis 209 the end 207' of the lever perforates the can in location 208' and approaches bar 218. If the lever is pivoted further it pushes the bar and its end 219 bends the side 250 of the basket outwardly. It can be realized that by virtue of this provision the folded extension residing within the basket is not held any more in folded position, it unfolds and falls down to approach the content of the can.

Figure 32:
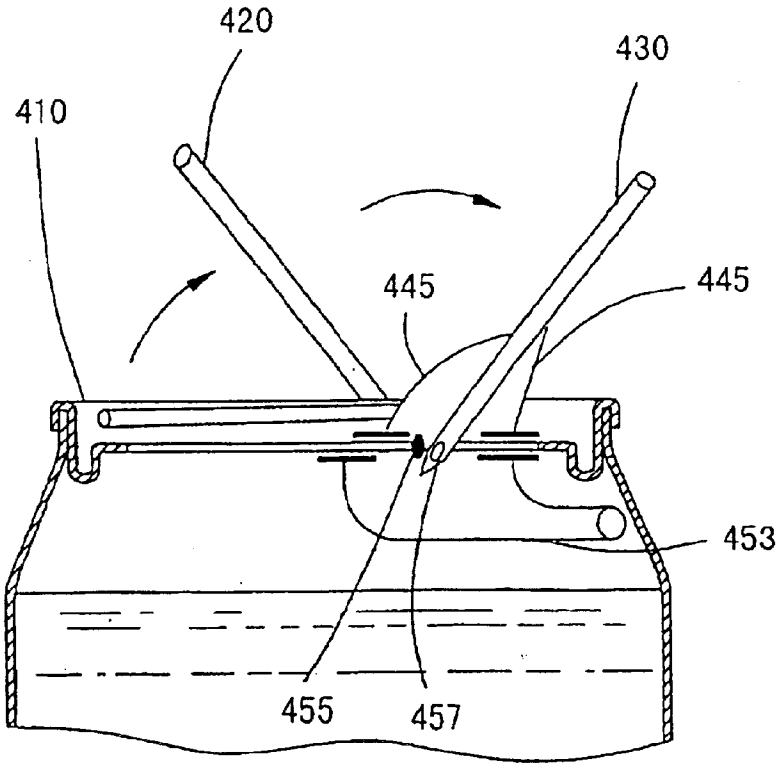
Figure 31:
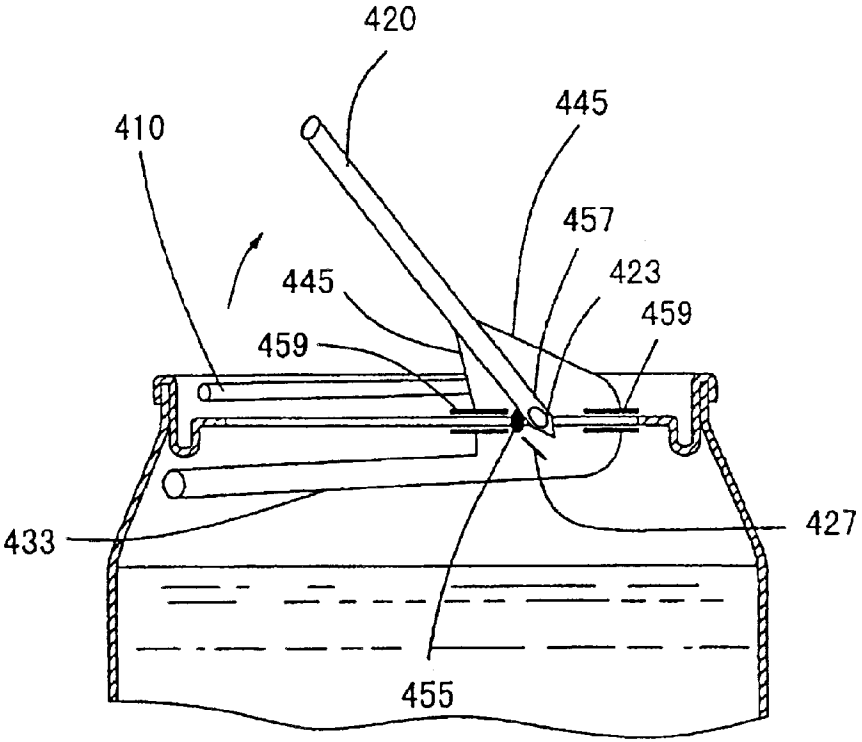

Turning now to FIGS. 31, 32 still further embodiment of my invention is shown. In this embodiment a tubular lever is used for opening the can. In FIG. 31 the lever can reside or on the cover of a can as designated at 410 or be pivoted with respect to an axis 455 so as to be brought in position designated at 420. That extremity of the lever which is close to the cover is connected therewith by an inlet means 445 situated on the lever and connected to the cover in a location 459. This location is situated within a region of weakness 427 provided in the cover. The region of weakness can be easily ruptured by the extremity 423 of the lever when it is lifted up. Beneath the cover there is arranged a flexible tubular extension 433 connected to the cover in the region of weakness opposite to the location 459. It can be realized that when the tubular lever is in the upper position it is in communication with the flexible extension and the beverage can be consumed through the extension 433 and the lever. The embodiment shown in FIG. 32 differs from the previous embodiment only in that the flexible extension 453 is directed in the opposite direction as compared to the flexible extension 433 shown in FIG. 31. It should be appreciated that the present invention is not limited by the above-described embodiments and that changes and modifications can be made by one ordinarily skilled in the art without deviation from the scope of the invention as will be defined below in the appended claims. It should also be appreciated that features disclosed in the foregoing description, and/or in the following claims, and/or in the accompanying drawings may, both separately and in any combination thereof, be material for realizing the present invention in diverse forms thereof.

What is claimed is:

1. A container for liquid, e.g. a beverage, said container comprising:

a body portion for retaining the liquid therein and a cover portion closing the body portion, said cover portion is formed with a line of weakness defining a tear portion which is at least partly removable from the cover portion when said line of weakness is ruptured, said tear portion is bendable inwardly so as to create an opening in the cover portion and enable access therethrough to the content of the body portion, a tubular member residing above the cover portion, said tubular member is capable to communicate with the content of the container upon rupturing the cover portion along the line of weakness and bending the tear portion, said tubular member is defined by its first and second end, the first end of the tubular member is affixed to the cover portion in a location defined by said line of weakness, the second end of the tubular member is accessible for drinking the liquid therethrough, a rupture means suitable for rupturing said cover portion along the line weakness so as to establish communication between the tubular member and the content of the container, an extension member, said extension member is defined by tubular body portion and by its first and second end, said extension member resides beneath the cover portion, the first end of the extension member is affixed to the cover portion in a location defined by said line of weakness to enable communication between the tubular member and the extension member when the cover portion is ruptured, the second end of the extension member is capable to approach the liquid for consuming thereof.

2. The container as defined in claim 1, in which said rupture means is formed as a lever located on the cover portion with possibility for pivoting about an axis directed parallel to the cover portion, said lever is defined by a first extremity and opposite therewith second extremity, said first extremity of the lever is suitable for pivoting the lever while being lifted up, the second extremity of the lever is capable to approach the cover portion and to rupture thereof along the line of weakness.

3. The container as defined in claim 2, comprising a cork member suitable for closing the second end of the tubular member and preventing spilling out the liquid therefrom.

4. The container as defined in claim 3, in which said extension member is formed with several folds, said extension member is capable to unfold upon pivoting the lever and to protrude inside the container.

5. A container for liquid, e.g. a beverage, said container comprising a body portion for retaining the liquid therein and a cover portion closing the body portion, said cover portion is formed with a line of weakness defining a tear portion which is at least partly removable from the cover portion when said line of weakness is ruptured, said tear portion is bendable inwardly so as to create an opening in the cover portion and enable access therethrough to the content of the body portion, a rupture means suitable for rupturing said cover portion along the line weakness so as to establish communication with the content of the container, said rupture means is formed as a lever located on the cover portion with possibility for pivoting about an axis directed parallel to the cover portion, said lever is configured as elongated tubular body defined by a first extremity and opposite therewith second extremity, said first extremity is suitable for lifting thereof up and pivoting the lever, while the second extremity is capable to approach the cover portion upon pivoting the lever and to cause rupturing thereof along the line or weakness and, said second extremity is connected with a tubular flexible extension member, said extension member is capable to protrude through the opening created in the cover portion upon rupturing thereof so as to enable consuming the liquid therethrough.

6. The container as defined in claim 5, in which the second extremity of said tubular lever is provided with a sealing means, said sealing means is suitable for preventing spilling out the liquid through the opening created in the cover portion.

7. The container as defined in claim 6, comprising a closure means for closing the first extremity of the lever.

8. The container as defined in claim 7, in which said extension is formed with reinforcing ribs.

9. The container as defined in claim 8, in which said extension comprises several folds, said folds are capable to straighten once the lever is pivoted so as to rupture the cover portion along the line of weakness.

* * * * *